US007097485B1

(12) United States Patent
Wang et al.

(10) Patent No.: US 7,097,485 B1
(45) Date of Patent: Aug. 29, 2006

(54) ELECTRICAL CONNECTOR HAVING RESILIENT CONDUCTIVE TERMINALS

(75) Inventors: Ching-Shun Wang, Taipei Hsien (TW); Ming-Chung Wang, Taipei Hsien (TW)

(73) Assignee: Advanced Connection Technology Inc., (TW)

( * ) Notice: Subject to any disclaimer, the term of this patent is extended or adjusted under 35 U.S.C. 154(b) by 0 days.

(21) Appl. No.: 11/293,054

(22) Filed: Dec. 2, 2005

(51) Int. Cl.
*H01R 13/28* (2006.01)
*H01R 25/00* (2006.01)

(52) U.S. Cl. ..... 439/289; 439/700

(58) Field of Classification Search ..... 439/289, 439/700, 500, 861
See application file for complete search history.

(56) References Cited

U.S. PATENT DOCUMENTS 4,636,026 A * 1/1987 Cooney et al. ..... 439/482
4,838,801 A * 6/1989 Bertoglio et al. ..... 439/83
5,192,213 A * 3/1993 Kosugi et al. ..... 439/66
5,215,472 A * 6/1993 DelPrete et al. ..... 439/71
5,362,241 A * 11/1994 Matsuoka et al. ..... 439/66
6,241,560 B1 * 6/2001 Furusawa et al. ..... 439/700

* cited by examiner

*Primary Examiner*—Hae Moon Hyeon
(74) *Attorney, Agent, or Firm*—DLA Piper Rudnick Gray Cary US LLP

(57) ABSTRACT

An electrical connector includes a terminal-mounting seat configured with receiving spaces. Each of conductive members has a connecting base connected to a contact block that is disposed in the respective receiving space. Each of conductive terminals has a lower clamping end portion abutting against and contacting electrically and movably the contact block of the respective conductive member, and an upper contact end portion extending outwardly of the terminal-mounting seat via a respective one of guiding grooves in a top surface of the terminal-mounting seat. Upon depression by an electronic device, the resilient conductive terminals deform to provide a restoring force to bias the upper contact end portion thereof upwardly to contact electrically a respective one of electrical contacts of the electronic device.

3 Claims, 4 Drawing Sheets

ELECTRICAL CONNECTOR HAVING RESILIENT CONDUCTIVE TERMINALS

BACKGROUND OF THE INVENTION

1. Field of the Invention

The invention relates to an electrical connector, more particularly to an electrical connector having a plurality of resilient conductive terminals.

2. Description of the Related Art

A conventional electrical connector applied to a charger generally includes a plurality of conductive terminals mounted movably in a dielectric housing, a plurality of conductive members disposed in the dielectric housing and connected electrically to a circuit board, and a plurality of compression springs, each of which is mounted between a respective conductive terminal and a respective conductive member for biasing the respective conductive terminal from a depressed position, where the respective conductive terminal contacts electrically the respective conductive member, to a released position, where the respective conductive terminal does not contact electrically the respective conductive terminal.

SUMMARY OF THE INVENTION

The object of the present invention is to provide an electrical connector having a simplified structure that can be fabricated at a relatively low cost.

According to the present invention, there is provided an electrical connector for an electronic device. The electronic device has a contact surface formed with a plurality of electrical contacts. The electrical connector comprises:

a terminal-mounting seat configured with a plurality of receiving spaces, each of which is defined by an inner circumferential wall, and having a top surface adapted to face the contact surface of the electronic device and formed with a plurality of guiding grooves, each of which is adapted to correspond to a respective one of the electrical contacts on the contact surface of the electronic device and is in spatial communication with a respective one of the receiving spaces, and a bottom surface formed with a plurality of openings, each of which is in spatial communication with a respective one of the receiving spaces;

a plurality of conductive members, each of which has a contact block disposed in a respective one of the receiving spaces in the terminal-mounting seat, and a connecting base connected to the contact block and extending outwardly of the terminal-mounting seat via a respective one of the openings, the contact block of each of the conductive members having an inclined guiding surface member; and a plurality of resilient conductive terminals disposed respectively in the receiving spaces in the terminal-mounting seat and adapted to correspond respectively to the electrical contacts of the electronic device, each of the conductive terminals being mounted movably between a respective one of the inner circumferential walls of the terminal-mounting seat and a respective one of the conductive members, and having a lower clamping end portion that abuts against and that contacts electrically and movably the inclined guiding surface member of the contact block of the respective one of the conductive members, and an upper contact end portion opposite to the lower clamping end portion and extending outwardly of the terminal-mounting seat via a respective one of the guiding grooves. Each of the resilient conductive terminals deforms when depressed by the contact surface of the electronic device, and provides a restoring force so as to bias the upper contact end portion thereof upwardly to contact electrically the respective one of the electrical contacts of the electronic device.

Since, there is no requirement for additional resilient elements to press the conductive terminals against the electronic device, manufacturing costs can be reduced acccordingly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
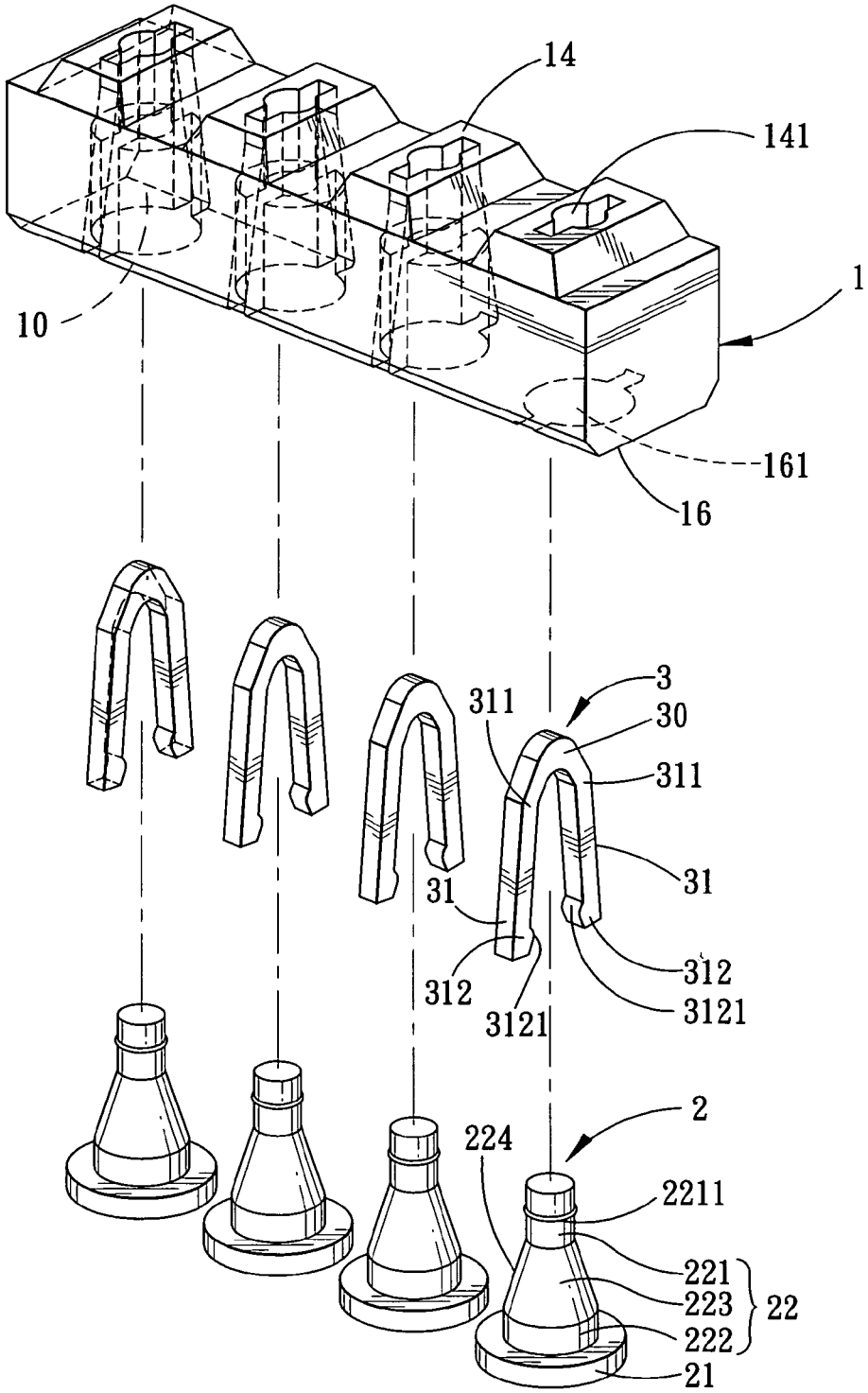
FIG. 1 is an exploded perspective view showing the first preferred embodiment of an electrical connector according to the present invention.

Before the present invention is described in greater detail, it should be noted that like elements are denoted by the same reference numerals throughout the disclosure.

Figure 2:
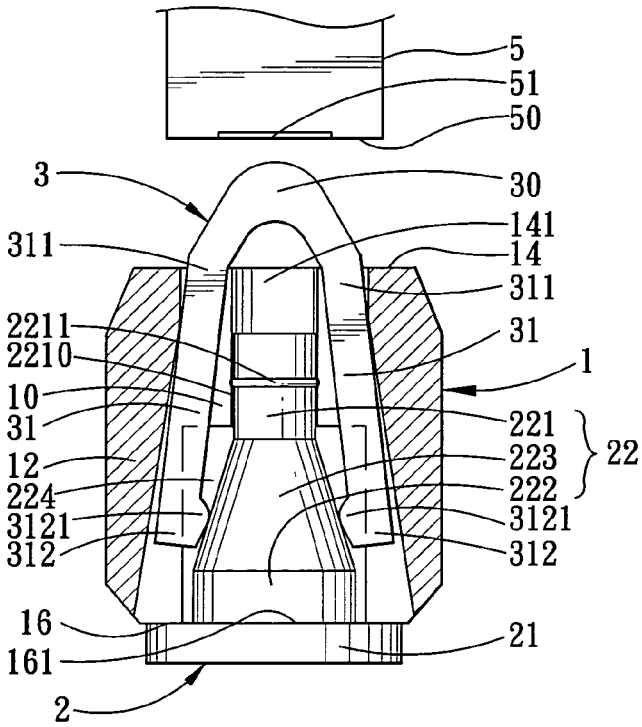
FIG. 2 is a schematic partly sectional view showing the first preferred embodiment.

Referring to FIGS. 1 and 2, the first preferred embodiment of an electrical connector according to the present invention is shown to be adapted for use with an electronic device 5. In this embodiment, the electrical connector is applied to a charger (not shown), and the electronic device 5 is a rechargeable battery, and has a contact surface 50 formed with a plurality of electrical contacts 51 (only one is illustrated), as shown in FIG. 2. The electrical connector includes a terminal-mounting seat 1, a plurality of conductive members 2, and a plurality of resilient terminals 3.

The terminal-mounting seat 1 is made of an insulation material, and has a plurality of receiving spaces 10, a top surface 14, and a bottom surface 16. Each of the receiving spaces 10 is defined by an inner circumferential wall 12 (see FIG. 2). The top surface 14 is adapted to face the contact surface 50 of the electronic device 5, and is formed with a plurality of guiding grooves 141. Each of the guiding grooves 141 is adapted to correspond to a respective one of the electrical contacts 51 on the contact surface 50 of the electronic device 5, and is in spatial communication with a respective one of the receiving spaces 10. The bottom surface 16 is formed with a plurality of openings 161, each of which is in spatial communication with a respective one of the receiving spaces 10.

Each of the conductive members 2 has a contact block 22 disposed in a respective one of the receiving spaces 10 in the terminal-mounting seat 1, and a circular connecting base 21 connected to the contact block 22 and extending outwardly of the terminal-mounting seat 1 via a respective one of the openings 161. In this embodiment, the connecting base 21 is adapted to be connected electrically to a circuit board (not shown) of the charger. The contact block 22 of each conductive member 2 has an inclined guiding surface member. In this embodiment, for each conductive member 2, the contact block 22 has a cylindrical narrower upper portion 221, a cylindrical wider lower portion 222 wider than the upper portion 221, and a truncately conical intermediate portion 223 interconnecting the upper and lower portions 221, 222 and having an annular outer circumferential surface 224 that serves as the inclined guiding surface member. The upper portion 221 of the contact block 22 has an annular outer surface 2210 formed with a stop ring 2211.

The resilient conductive terminals 3 are disposed respectively in the receiving spaces 10 in the terminal-mounting seat 1, and are adapted to correspond respectively to the electrical contacts 51 of the electronic device 5. Each conductive terminal 3 is mounted movably between a respective one of the inner circumferential walls 12 of the terminal-mounting seat 1 and a respective one of the conductive members 2. Each conductive terminal 3 has a lower clamping end portion that abuts against and that contacts electrically and movably the inclined guiding surface member of the contact block 22 of the respective conductive member 2, and an upper contact end portion opposite to the lower clamping end portion and extending outwardly of the terminal-mounting seat 1 via a respective one of the guiding grooves 141. In this embodiment, each conductive terminal 3 is formed as a substantially inverted U-shaped clamp, and has opposite clamping arms 31 and a curved section 30. Each clamping arm 31 has a coupling end 311, and a free end 312 opposite to the coupling end 311. The curved section 30 serves as the upper contact end portion, and interconnects integrally the coupling ends 311 of the clamping arms 31. The free ends 312 of the clamping arms 31 constitute the lower clamping end portion, and clamp the corresponding contact block 22 therebetween. The free end 312 of each clamping arm 31 is formed with a projecting contact 3121 extending toward and contacting electrically the outer circumferential surface 224 of the intermediate portion 223 of the contact block 22 of the respective conductive member 2. Each stop ring 2211 is sized so as to prevent passage of the corresponding projecting contact 3121 through a space between the stop ring 2211 and the corresponding inner circumferential wall 12 of the terminal-mounting seat 1.

Figure 3:
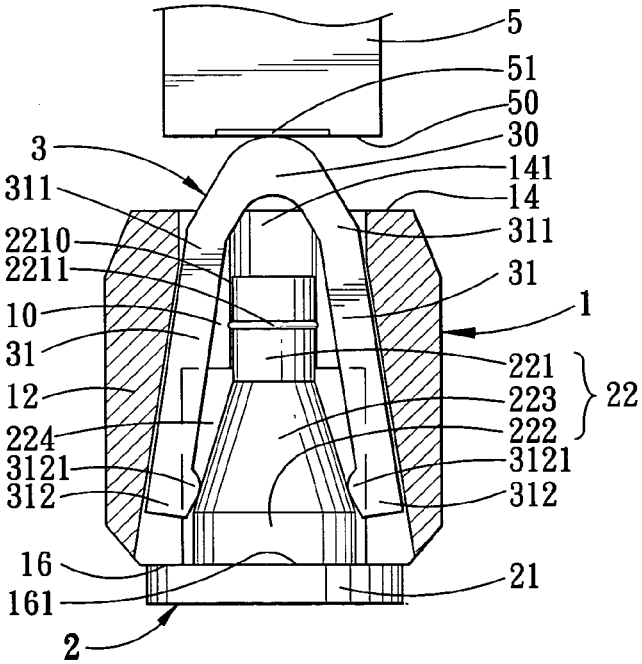
FIG. 3 is a schematic partly sectional view showing the first preferred embodiment in a state of use.

In use, referring to FIG. 3, the resilient conductive terminals 3 are deformed when the resilient conductive terminals 3 are depressed by the contact surface 50 of the electronic device 5. As such, each of the deformed conductive terminals 3 provides a restoring force so as to bias the upper contact end portion (i.e., the curved section 30) thereof upwardly to contact electrically the respective one of the electrical contacts 51 of the electronic device 5. Furthermore, due to the presence of the stop ring 2211 on the upper portion 221 of the contact block 22 of each conductive member 2, removal of each conductive terminal 3 from the respective receiving space 10 in the terminal-mounting seat 1 can be prevented.

Figure 4:
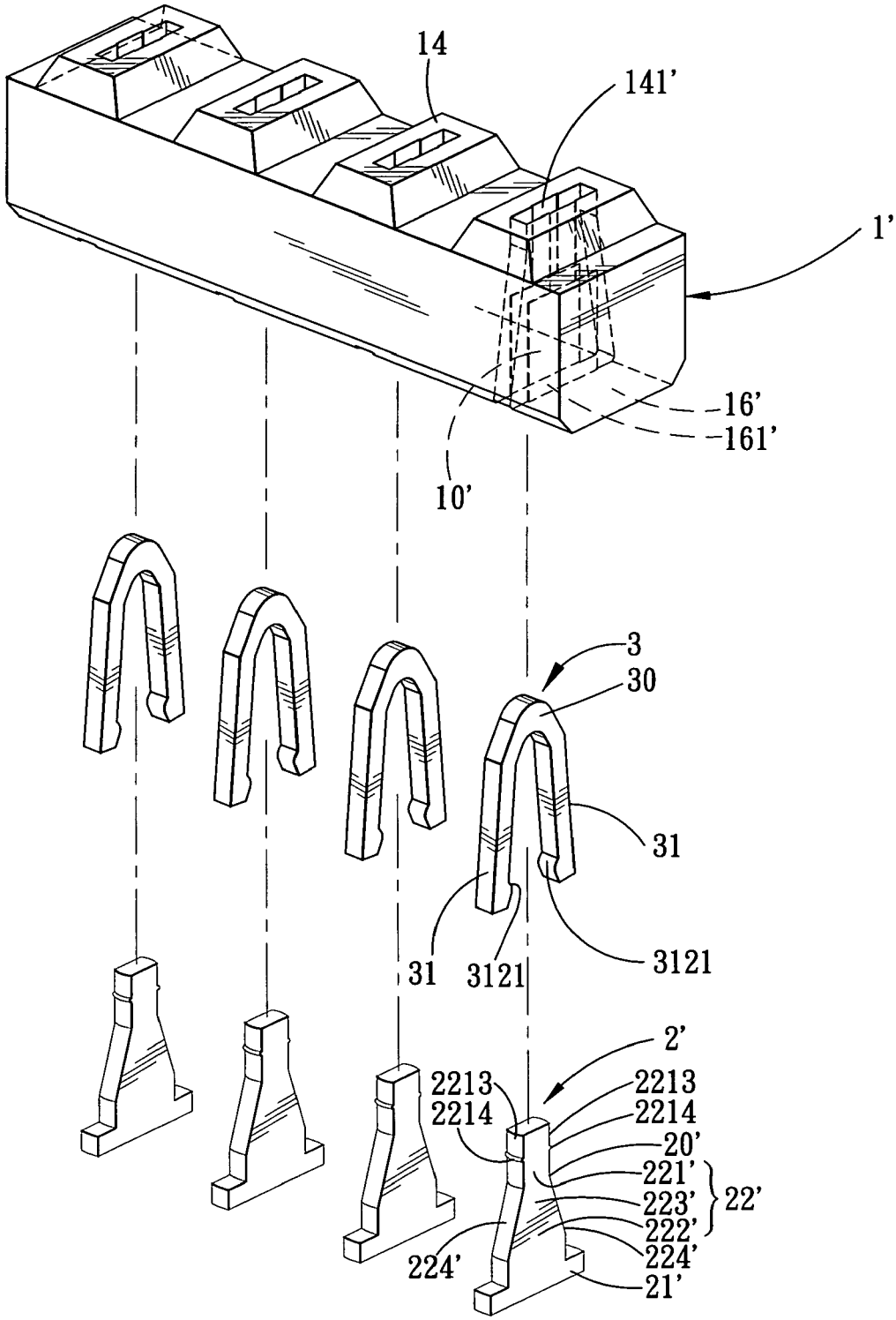
FIG. 4 is an exploded perspective view showing the second preferred embodiment of an electrical connector according to the present invention.
Figure 5:
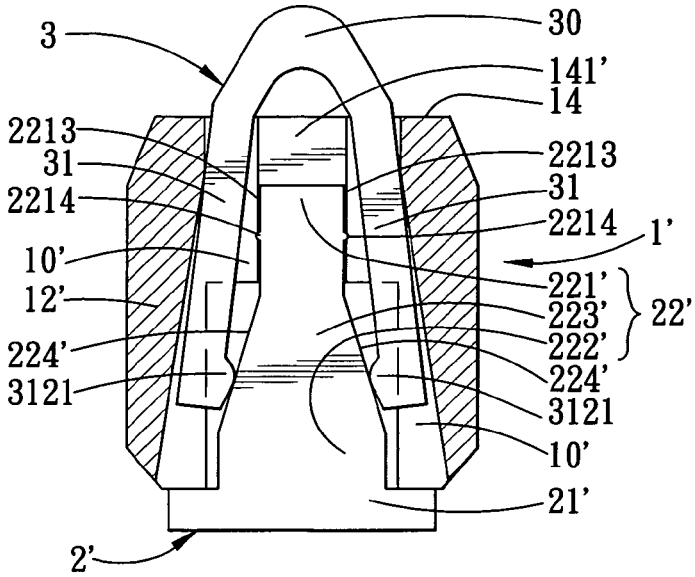
FIG. 5 is a schematic partly sectional view showing the second preferred embodiment.

FIGS. 4 and 5 illustrate the second preferred embodiment of an electrical connector according to this invention, which is a modification of the first preferred embodiment. In this embodiment, each receiving space 10' in the terminal-mounting seat 1' is generally trapezoidal. Moreover, for each conductive member 2', which can be formed by punching, each of the upper and lower portions 221', 222' of the contact block 22' is rectangular, and the intermediate portion 223' of the contact block 22' is a trapezoidal block having two opposite lateral surfaces 224' that constitute the inclined guiding surface member. The upper portion 221' of the contact block 22' has two opposite lateral surfaces 2213, each of which is formed with a stop flange 2214. Each stop flange 2214 is sized so as to prevent passage of the corresponding projecting contact 3121 through a space between the stop flange 2214 and the corresponding inner circumferential wall 12' of the terminal-mounting seat 1'.

Figure 6:
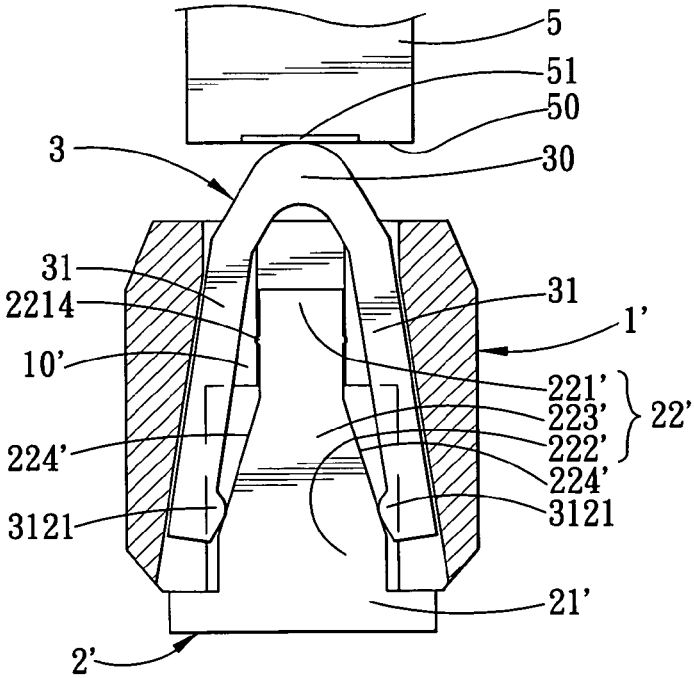
FIG. 6 is a schematic partly sectional view showing the second preferred embodiment in a state of use.

In use, referring to FIG. 6, the resilient conductive terminals 3 are deformed when the resilient conductive terminals 3 are depressed by the contact surface 50 of the electronic device 5. As such, each of the deformed conductive terminals 3 provides a restoring force so as to bias the upper contact end portion (i.e., the curved section 30) thereof upwardly to contact electrically the respective one of the electrical contacts 51 of the electronic device 5. Furthermore, due to the presence of the stop flanges 2214 on the upper portion 221' of the contact block 22' of each conductive member 2', removal of each conductive terminal 3 from the respective receiving space 10' in the terminal-mounting seat 1' can be prevented.

It is noted that there is no requirement for resilient elements, such as the compression springs in the prior art. Therefore, the electrical connector of the present invention has a simplified structure that can be fabricated at a relatively low cost.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electrical connector for an electronic device, the electronic device having a contact surface formed with a plurality of electrical contacts, said electrical connector comprising:

a terminal-mounting seat configured with a plurality of receiving spaces, each of which is defined by an inner circumferential wall, and having a top surface adapted to face the contact surface of the electronic device and formed with a plurality of guiding grooves, each of which is adapted to correspond to a respective one of the electrical contacts on the contact surface of the electronic device and is in spatial communication with a respective one of said receiving spaces, and a bottom surface formed with a plurality of openings, each of which is in spatial communication with a respective one of said receiving spaces;

a plurality of conductive members, each of which has a contact block disposed in a respective one of said receiving spaces in said terminal-mounting seat, and a connecting base connected to said contact block and extending outwardly of said terminal-mounting seat via a respective one of said openings, said contact block of each of said conductive members having an inclined guiding surface member; and a plurality of resilient conductive terminals disposed respectively in said receiving spaces in said terminal-mounting seat and adapted to correspond respectively to the electrical contacts of the electronic device, each of said conductive terminals being mounted movably between a respective one of said inner circumferential walls of said terminal-mounting seat and a respective one of said conductive members, and having a lower clamping end portion that abuts against and that contacts electrically and movably said inclined guiding surface member of said contact block of the respective one of said conductive members, and an upper contact end portion opposite to said lower clamping end portion and extending outwardly of said terminal-mounting seat via a respective one of said guiding grooves, said resilient conductive terminals deforming when said resilient conductive terminals are depressed by the contact surface of the electronic device, and providing a restoring force so as to bias said upper contact end portion thereof upwardly to contact electrically the respective one of the electrical contacts of the electronic device;

each of said resilient conductive terminals being formed as a substantially inverted U-shaped clamp, and having opposite clamping arms, each of which has a coupling end, and a free end opposite to said coupling end, and a curved section that serves as said upper contact end portion and that interconnects integrally said coupling ends of said clamping arms, said free ends of said clamping arms constituting said lower clamping end portion, said free ends of said clamping arms of each of said resilient conductive terminals clamping said contact block of the respective one of said conductive members therebetween;

said free end of each of said clamping arms of said conductive terminals being formed with a projecting contact extending toward and contacting electrically said inclined guiding surface member of a corresponding one of said conductive members;

said contact block of each of said conductive members having a narrower upper portion, a wider lower portion wider than said upper portion, and an intermediate portion interconnecting said upper and lower portions and having said inclined guiding surface member;

each of said upper and lower portions of said contact block of each of said conductive members being cylindrical, said intermediate portion of said contact block of each of said conductive members being truncately conical and having an annular outer circumferential surface that serves as said inclined guiding surface member; and said upper portion of said contact block of each of said conductive members having an annular outer surface formed with a stop ring that is sized so as to prevent passage of a corresponding, one of said projecting contacts through a space between said stop ring and a corresponding one of said inner circumferential walls of said terminal-mounting seat.

2. The electrical connector as claimed in claim 1, wherein said intermediate portion of said contact block of each of said conductive members is a trapezoidal block having two opposite lateral surfaces that constitute said inclined guiding surface member.

3. The electrical connector as claimed in claim 2, wherein said upper portion of said contact block of each of said conductive members is rectangular, and has two opposite lateral surfaces, each of which is formed with a stop flange that is sized so as to prevent passage of a corresponding one of said projecting contacts through a space between said stop flange and a corresponding one of said inner circumferential walls of said terminal-mounting seat.

* * * * *